US009849686B2

(12) United States Patent
Kuwahara et al.

(10) Patent No.: US 9,849,686 B2
(45) Date of Patent: Dec. 26, 2017

(54) CHARGING METHOD AND CHARGING SYSTEM

(71) Applicant: SEIKO EPSON CORPORATION, Tokyo (JP)

(72) Inventors: Yuki Kuwahara, Shiojiri (JP); Shigeru Tsuji, Chino (JP); Takefumi Inui, Matsumoto (JP); Keiichi Taguchi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/211,363

(22) Filed: Jul. 15, 2016

(65) Prior Publication Data

US 2017/0015105 A1 Jan. 19, 2017

(30) Foreign Application Priority Data

Jul. 17, 2015 (JP) ..... 2015-142714

(51) Int. Cl.
*B41J 2/175* (2006.01)

(52) U.S. Cl.
CPC ..... *B41J 2/17566* (2013.01); *B41J 2/17506* (2013.01); *B41J 2/17509* (2013.01); *B41J 2/17546* (2013.01); *B41J 2/17543* (2013.01); *B41J 2002/17569* (2013.01); *B41J 2002/17579* (2013.01)

(58) Field of Classification Search
CPC B41J 2/17566; B41J 2/17506; B41J 2/17543; B41J 2002/17579; B41J 2/17546; B41J 2/17509; B41J 2002/17569
See application file for complete search history.

(56) References Cited

U.S. PATENT DOCUMENTS

2007/0103716 A1* 5/2007 Shiraiwa ..... G03G 21/02 358/1.14
2013/0072152 A1* 3/2013 Ota ..... H04M 15/28 455/406

FOREIGN PATENT DOCUMENTS

JP 2006-035856 A 2/2006
JP 2007-128465 A 5/2007

* cited by examiner

*Primary Examiner* — Manish S Shah
*Assistant Examiner* — Yaovi M Ameh
(74) *Attorney, Agent, or Firm* — Foley & Lardner LLP

(57) ABSTRACT

The invention relates to a method of charging for ink in an ink container consumed by a printing unit during printing. The method of charging includes obtaining information on an amount of the ink consumed; and implementing charging on the basis of the information. Before the amount of the ink in the ink container consumed reaches a predetermined value, first charging is implemented according to a charging basis in which usage-based charging is implemented on the basis of the amount of the ink consumed. After the amount of the ink consumed reaches the predetermined value, second charging is implemented according to a charging basis different from the charging basis applied to the first charging.

16 Claims, 6 Drawing Sheets

CHARGING METHOD AND CHARGING SYSTEM

BACKGROUND

1. Technical Field

The present invention relates to a method and a system of charging for an amount of ink in an ink container consumed during printing.

2. Related Art

For instance, in an apparatus including a printing device such as a copying machine or a printer, a consumable such as ink or toner is charged by the following methods. In one method, a certain amount is charged for each storage container such as a tank or a cartridge storing the ink or toner. In another method, in order to implement charging more faithful to actual ink usage during printing, usage-based charging is implemented on the basis of an ink or toner consumption amount. For instance, in the technique described in JP-A-2006-035856, the number of print dots are counted on the basis of image data, and a charge is calculated by multiplying a toner consumption amount obtained from the result of counting the print dots by predetermined price information.

In a case in which ink or toner is supplied to and stored in a container, the amount of the ink or toner filled into the container is generally more than an estimated consumption amount. This is to prevent the ink or toner in the container from being exhausted earlier than its predetermined life due to, for example, a measurement error of a consumption amount, adhesion to the inside of the container, and evaporation of a liquid component of the ink or toner.

In this case, if the usage-based charging is applied, users are also charged for the usage of an excess amount of the ink or toner prefilled. Thus, for instance, a usage-based charging charge may be more than a per-container basis charge. Since the excessive charging is in particular disadvantageous for the users, it should be avoided.

SUMMARY

An advantage of some aspects of the invention is that a technique is provided for appropriately charging on the basis of actual ink consumption in a method and a system of charging for an amount of ink in an ink container consumed during printing.

A charging method according to an aspect of the invention is a method of charging for ink in an ink container consumed by a printing unit during printing. The method includes: obtaining information on an amount of the ink consumed; and implementing charging on the basis of the information. Before the amount of the ink in the ink container consumed reaches a predetermined value, first charging is implemented according to a charging basis in which usage-based charging is implemented on the basis of the amount of the ink consumed. After the amount of the ink consumed reaches the predetermined value, second charging is implemented according to a charging basis different from the charging basis applied to the first charging.

In this aspect of the invention, by implementing the usage-based charging until the ink consumption amount reaches the predetermined value, charging based on the ink consumption amount is possible. Meanwhile, when the ink consumption amount reaches the predetermined value, the charging basis can be changed. This can avoid excessive charging from being incurred when the usage-based charging is uniformly implemented for total ink consumption, thereby preventing disadvantages for a user. Thus, according to this aspect of the invention, appropriate charging can be implemented on the basis of actual ink usage by the user.

For instance, a charging basis on which a charge per ink consumption amount is less than a charge per ink consumption amount in the first charging may be applied to the second charging. According to this aspect, a charge after the ink consumption amount reaches the predetermined value can be set to a lower amount. This enables implementation of reasonable charging for both the user and an ink supplier.

For instance, the charge of the second charging may be zero. This can prevent the user from being charged for an excess amount of ink filled due to the convenience of the ink supplier.

Otherwise, for instance, in the second charging, one-time charging may be implemented for ink usage after the ink amount of the ink consumed reaches the predetermined value. According to this aspect, even if there is a charge error at the time of implementing the usage-based charging due to, for example, a measurement error of the ink consumption amount, the error can be corrected later at the time of implementing the one-time charging.

In this case, for instance, when the amount of the ink consumed exceeds the predetermined value and a predetermined charging start condition is satisfied, the second charging may be implemented. According to this aspect, it is possible to avoid implementing charging immediately after the ink consumption amount exceeds the predetermined value. This enables charging based on usage thereafter by the user.

Specifically, for instance, if the ink container is attachable to and detachable from the printing unit, the charging start condition may be that an unused ink container has been attached to the printing unit. When the ink container is detached and the new ink container is attached, the use of the ink container which has been used can be considered finished. Charging is implemented at the time of attaching the new ink container. Thus, charging based on an amount of ink in the detached ink container consumed is implemented without charging for unused ink left in the ink container.

In another example, the charging start condition may be that exhaustion of the ink in the ink container is detected. It should be noted that "exhaustion of the ink" does not mean that the amount of ink left in the ink container has reached zero, but that the amount of ink left falls below the minimum amount of ink necessary for performing printing and that printing with the ink container is no longer possible. This enables implementation of appropriate charging based on the amount of ink in the ink container consumed.

In another example, the charging start condition may be that ink refilling for the ink container is detected. This enables implementation of appropriate charging for the ink used before the ink refill.

For instance, the "predetermined value" according to an aspect of the invention may be set so that when the amount of ink in the ink container consumed reaches the predetermined value, the amount of ink left in the ink container is more than the minimum amount of ink necessary for performing printing. According to this aspect, printing can be performed at a predetermined quality until the ink consumption amount reaches the predetermined value. By implementing the usage-based charging during the period, charging based on actual ink consumption is possible.

For instance, the predetermined value may be changed according to the elapsed time since the use of the ink container is started. According to this aspect, even if ink density in the ink container is changed due to evaporation of a liquid component, appropriate charging based on an actual ink consumption amount is possible by reflecting the change of the ink density in the charging basis.

Moreover, in the method of charging according to the aspect of the invention, a charging device may obtain the information from the printing unit connected to the charging device via a communications network, and implement charging. Here, the charging device and the printing unit may be provided in different places. Thus, for instance, an ink distributor can check the status of ink usage by a customer from a remote location and implement charging.

Moreover, a charging system according to an aspect of the invention includes: a printing unit that performs printing using ink in an ink container; an information obtaining unit that obtains information on an amount of the ink consumed by the printing unit; and a charging implementation unit that charges for the amount of the ink consumed by the printing unit, on the basis of the information obtained by the information obtaining unit. Before the amount of the ink in the ink container consumed reaches a predetermined value, the charging implementation unit implements charging according to a charging basis in which usage-based charging is implemented on the basis of the amount of the ink consumed. When the amount of the ink consumed reaches the predetermined value, the charging basis is changed.

This aspect of the invention can solve the problems caused by the uniform usage-based charging and enable implementation of appropriate charging based on actual usage, as described in the above method of charging, which is another aspect of the invention.

In this charging system, the ink container may be, for instance, detachably attached to the printing unit. According to this aspect, ink container exchange enables continuous use of the printing unit, and the appropriate charging based on the ink consumption amount can be implemented for each ink container used.

For instance, the charging system may further include a notification unit that makes a notification when the amount of the ink consumed reaches the predetermined value. According to this aspect, the user can be informed that there is a small amount of ink left in the ink container. This helps the user manage consumables. For instance, by being informed of the change of the charging basis, the user can decide how to use the ink container currently in use.

For instance, in the charging system, the printing device including the printing unit and the information obtaining unit may be connected to a charging device including the charging implementation unit via a communications network. Otherwise, the printing device including the printing unit may be connected to the charging device including the information obtaining unit and charging implementation unit via the communications network. In either case, charging management of the printing device installed at a remote location can be appropriately performed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
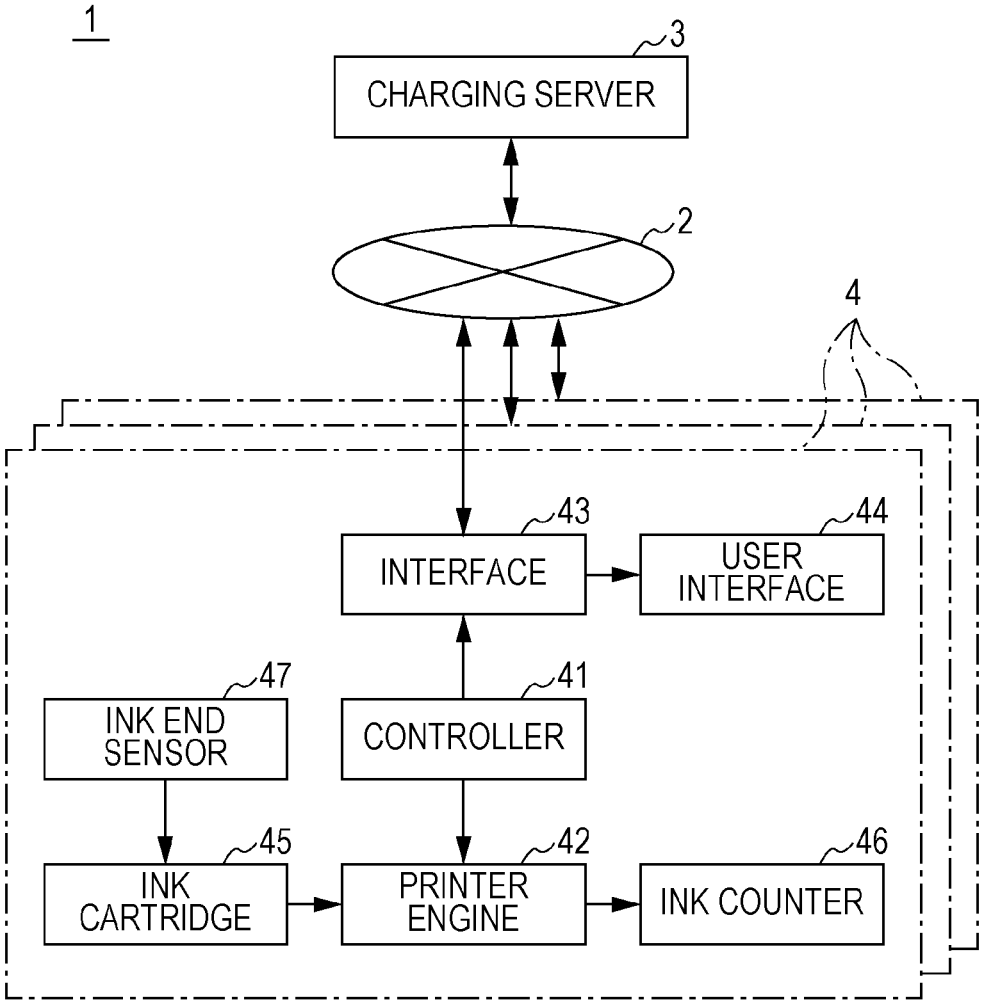
FIG. 1 is a block diagram illustrating a configuration example of a charging system to which the invention is applicable.

FIG. 1 is a block diagram illustrating a configuration example of a charging system to which the invention is applicable. A charging system 1 includes at least one charging server 3 and at least one printer 4 that are communicably connected to one another via an Internet communications network 2 as a public network. It should be noted that in FIG. 1, the charging server 3 and the printer 4 are directly connected via the Internet communications network 2. However, for instance, the printer 4 may be located on a local area network (LAN) and connected to the charging server 3 via the LAN and the Internet communications network 2. Moreover, the charging server 3 and the printer 4 can be connected via any communications network capable of communicably connecting the charging server 3 and the printer 4 to one another, and the connection is not necessarily via the Internet communications network 2.

The charging server 3 charges for ink that is a consumable consumed by the printer 4 in printing operations. For instance, the charging server 3 is installed at an ink supplier such as an ink cartridge manufacturer or a distributor that sells ink to the users of the printers 4. Information on ink consumption status of the printer 4 is transmitted to the charging server 3 via the Internet communications network 2. The charging server 3 determines from the received information a charge based on the consumption status.

The hardware configuration of the charging server 3 may be similar to that of general computers or servers. That is, the charging server 3 includes a central processing unit (CPU), memory, storage, and an interface. The CPU performs arithmetic processing. The memory stores data used for computation. The storage stores control programs and various data. The interface enables communications with an external device.

The printer 4 is a network printer and has a configuration similar to a typical configuration of a network printer. That is, the printer 4 includes a controller 41, a printer engine 42, an interface (IF) 43, and a user interface (UI) 44. The controller 41 performs control of the components of the printer 4 and data processing. The printer engine 42 performs printing operations for a medium (print medium). The interface 43 performs external communications. The user interface 44 includes an input unit that accepts user-manipulated input and a display unit that provides a user with various information.

The printer engine 42 has an ink jet printing function. Using the function, the printer engine 42 performs printing by ejecting minute droplets of ink through nozzles and placing the droplets onto the medium on the basis of image data denoting the content of an image to be printed. The ink to be used for printing is supplied from an ink cartridge 45. The ink cartridge 45 is detachably attached to the main body of the printer 4. Printing is performed in a state in which one or more than one ink cartridge 45 is attached to the main body of the printer 4.

The printer 4 further includes an ink counter 46 and an ink end sensor 47 as components for measuring an amount of ink left in the ink cartridge 45 or an amount of ink in the ink cartridge 45 consumed. The ink counter 46 measures the size of the ink droplets ejected through the nozzles of the printer engine 42, counts the number of the ink droplets by analyzing the image data, and calculates the amount of ink in the ink cartridge 45 consumed.

Meanwhile, the ink end sensor 47 detects the end status in which the amount of ink left in the ink cartridge 45 falls below the minimum amount of ink necessary for printing and printing is no longer possible. The ink end sensor 47 detects the end status by, for example, physically measuring the position of an ink liquid level in the ink cartridge 45. Here, the physical measurement means optical measurement or a measurement made by using ultrasonic waves, for example. The end status is equivalent to a status in which usable ink in the ink cartridge 45 is almost exhausted. The ink end sensor 47 may be provided in either of the printer 4 and the ink cartridge 45.

Figure 2:
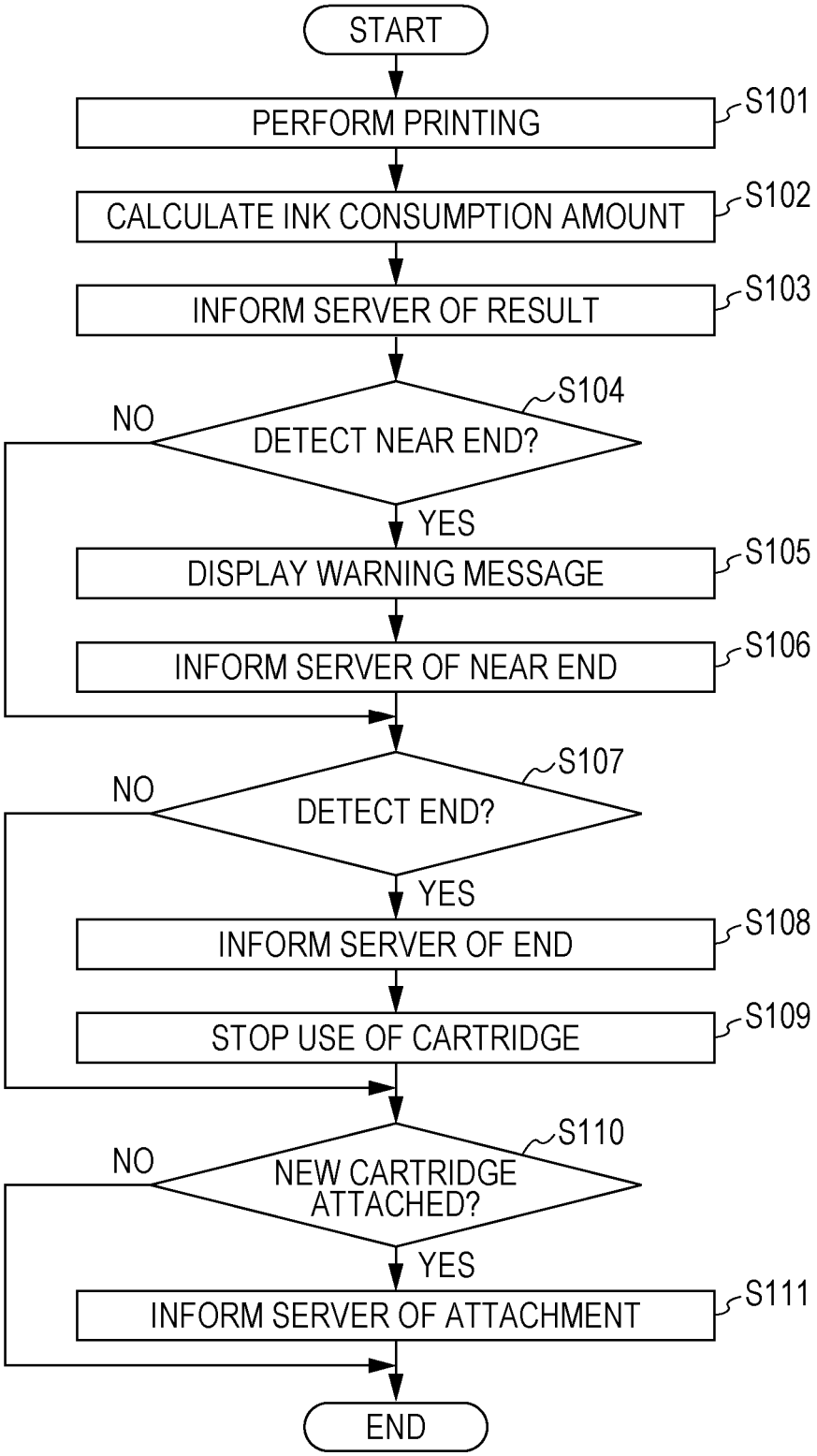
FIG. 2 is a flow chart illustrating an operation example of a printer.

FIG. 2 is a flow chart illustrating an operation example of the printer 4. Upon receiving from the user an instruction to perform a printing operation, the controller 41 of the printer 4 executes pre-stored control programs and controls the components of the printer 4. By so doing, the operations described below are performed. Upon receiving the instruction to perform the printing operation from the user or an external host computer, the controller 41 controls the printer engine 42 so that the predetermined printing operation is performed. Printing is thus performed on an appropriate medium (step S101).

The ink counter 46 analyzes image data corresponding to a printed image, and calculates the amount of ink consumed during the printing (step S102). Information on the calculated ink consumption amount is transmitted from the interface 43 to the charging server 3 via the Internet communications network 2 (step S103).

The controller 41 integrates an ink consumption amount for each printing operation calculated by the ink counter 46. Moreover, the integrated value may be written to memory (not illustrated) provided in the ink cartridge 45. The integrated value of the ink consumption amounts in the printing operations using the ink cartridge 45 corresponds to a total ink consumption amount in the ink cartridge 45. As the total ink consumption amount approaches an initial ink fill amount for the ink cartridge 45, ejection of ink through the nozzles is more likely to fail due to ink deterioration or the like, and image quality is more likely to degrade. In the end, printing is no longer possible.

In view of this, when the total ink consumption amount in the ink cartridge 45 reaches a predetermined threshold, it is determined that the status of the ink cartridge 45 is changed to "near end status", and the user is informed of the near end status of the ink cartridge 45. Until the total ink consumption amount reaches the threshold, good image quality can be maintained in printing using the ink cartridge 45. That is, the threshold of the ink consumption amount is set so that good image quality in printing is guaranteed until the status of the ink cartridge 45 is changed to the near end status. For instance, the threshold may be set to a value indicating around 90% of the initial ink fill amount, but is not necessarily this value.

When the status of the ink cartridge 45 is the near end status, the amount of ink left in the ink cartridge 45 is more than when the status of the ink cartridge 45 is the end status. The user can use at least an amount of ink corresponding to a near end value for printing without concern for image quality degradation. That is, the near end value indicates the amount of ink guaranteed to the user by the ink supplier.

The ink counter 46 estimates an ink consumption amount from the image data. However, there may be an error between the calculated ink consumption amount and an actual ink consumption amount. Moreover, the total amount of ink usable for printing may be less than the initial ink fill amount due to evaporation of a liquid component or ink adhesion to the inside of the ink cartridge 45. In view of these problems, to prevent image quality from starting to degrade before the near end status, the initial ink fill amount for the ink cartridge 45 may be more than the amount guaranteed to the user. Accordingly, a certain image quality can be maintained in printing using the ink cartridge 45 whose status is changed to the near end status.

When the printer 4 in the present embodiment integrates an ink consumption amount for each printing operation and detects that the integrated value reaches the above threshold, it is determined that the status of the ink cartridge 45 is changed to the near end status (step S104). By, for example, displaying a predetermined warning message in a display unit of the UI 44, the user is informed of the near end status of the ink cartridge 45 (step S105). This allows the user to estimate the end of the life of the ink cartridge 45 and to appropriately take measures such as preparation of a new cartridge and cartridge exchange. Moreover, the user can continue to use the ink cartridge 45 even after being informed of the near end status. This can avoid the immediate unavailability of the printer 4, and enables the effective use of the ink left in the ink cartridge 45.

Moreover, data denoting the near end status of the ink cartridge 45 is transmitted also to the charging server 3 via the Internet communications network 2 (step S106). Thus, the charging server 3 is also informed of the near end status of the ink cartridge 45. As described later, in the charging system 1, a charging basis for the ink cartridge 45 is changed before and after detecting the near end status.

When the amount of ink in the ink cartridge 45 consumed further increases from the ink consumption amount in the near end status and the amount of ink left decreases to a level at which printing is difficult to perform, the ink end sensor 47 detects the end status (step S107). Then, data denoting the end status of the ink cartridge 45 is transmitted to the charging server 3 (step S108), and the use of the ink cartridge 45 is stopped (step S109). That is, thereafter, the printer 4 cannot perform printing operations using the ink cartridge 45. This prevents the output of a printed product having degraded image quality.

Moreover, when the attachment of an unused ink cartridge 45 to the printer 4 is detected (step S110), data denoting the attachment is transmitted to the charging server 3 (step S111).

That is, the data respectively denoting, for example, the ink consumption amount, the near end status of the ink cartridge 45, and the end status of the ink cartridge 45 are transmitted from the printer 4 to the charging server 3. The charging server 3 charges for the ink cartridge 45 on the basis of these data as described below.

Figure 3:
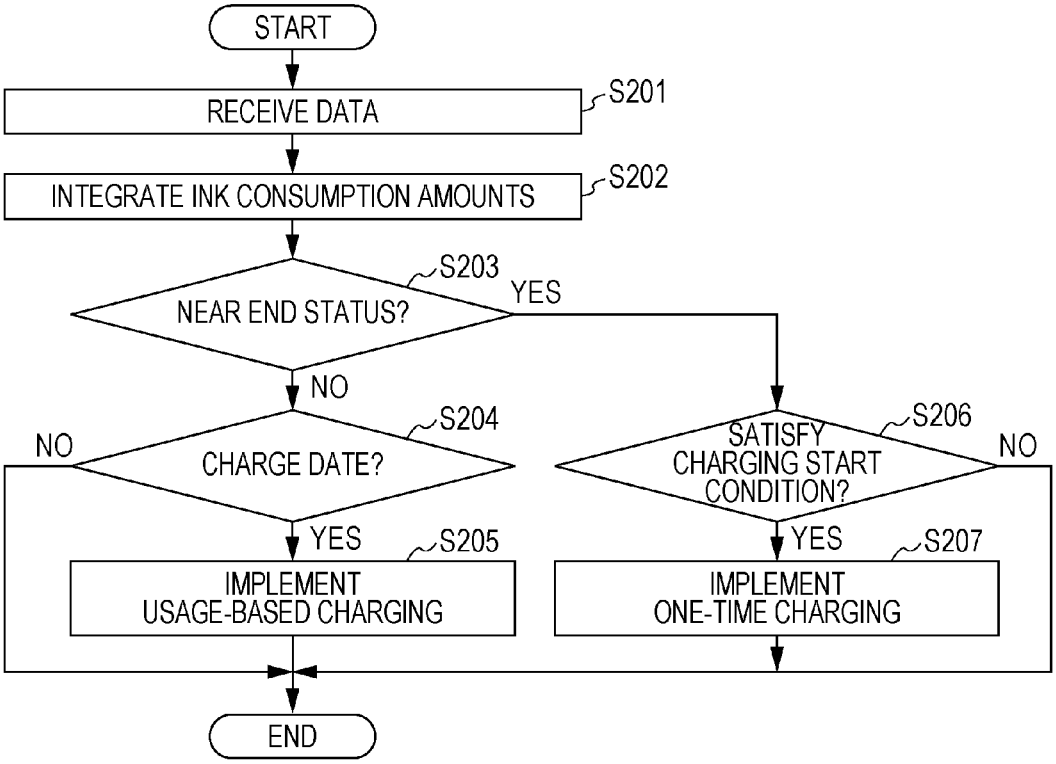
FIG. 3 is a flow chart illustrating an operation example of a charging server.

FIG. 3 is a flow chart illustrating an operation example of the charging server 3. If there is more than one printer 4 connected to the charging server 3 via the Internet communications network 2, the charging server 3 performs the following processing for each printer 4. The charging server 3 receives data transmitted from the printer 4 which has performed the printing operations (step S201). The charging server 3 integrates amounts of ink in the ink cartridge 45 consumed, on the basis of information on the ink consumption amounts included in respective data (step S202).

Thus, the charging server 3 is informed of the ink consumption status of the ink cartridge 45 in the printer 4. It should be noted that instead of receiving and integrating an ink consumption amount for each printing operation, the charging server 3 may receive and store a total ink consumption amount obtained by the printer 4 integrating the ink consumption amounts. Charging is implemented for the total amount of ink in the ink cartridge 45 consumed. The charging basis is different depending on whether or not the status of the ink cartridge 45 is near end (step S203).

Before the near end status of the ink cartridge 45 is detected (No in step S203), when a charge date decided between the user and the ink supplier, i.e., the end of a charging period such as a week or a month or a pre-specified date comes (Yes in step S204), charging is implemented. Specifically, a charge is calculated by multiplying an ink consumption amount during the charging period by a predetermined unit price, and the usage-based charging is implemented (step S205). That is, until the status of the ink cartridge 45 is changed to the near end status, a charge proportionate to the ink consumption amount is implemented every time the charge date comes.

Meanwhile, when the status of the ink cartridge 45 is the near end status (Yes in step S203), whether or not a predetermined charging start condition is satisfied is judged (step S206). There are different settings of the charging start condition, which will be described later. When the charging start condition is satisfied (Yes in step S206), one-time charging is implemented for the amount of ink which has been consumed from the start of the near end status to that time point (step S207). If the charging start condition is not satisfied (No in step S206), the charging is not implemented at that point.

Figure 4:
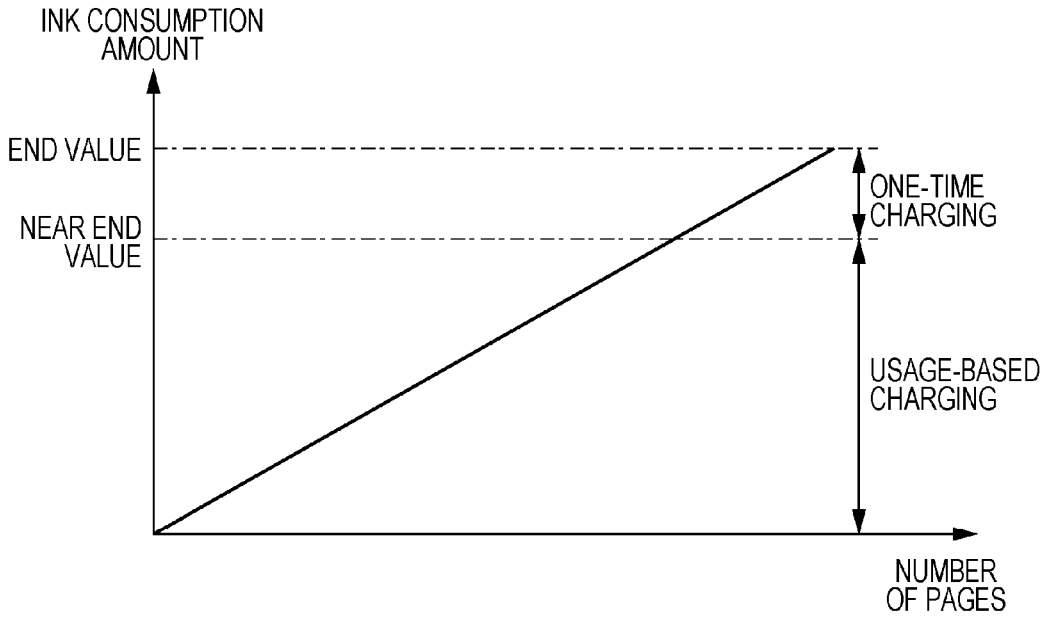
FIG. 4 illustrates a relationship between an ink consumption amount and a charging basis.

FIG. 4 illustrates a relationship between the ink consumption amount and the charging basis. The total ink consumption amount increases with an increase in the number of print pages, from the initial usage stage (consumption amount=0) of the ink of the ink cartridge 45. In a simplified example described here, an ink consumption amount per printed image page is constant, and the total ink consumption amount is proportionate to the number of printed pages. Until the ink consumption amount reaches "a near end value" corresponding to "the threshold", the charging basis is set to the usage-based charging in which a charge is proportionate to the ink consumption amount. In this charging basis, a certain image quality is guaranteed, and a charge proportionate to the ink consumption amount is implemented. Thus, this charging basis is likely to be accepted by users.

Meanwhile, once the ink consumption amount exceeds the near end value, printing is still possible but the image quality is not necessarily guaranteed. In particular, when the ink consumption amount approaches an end value corresponding to an ink consumption amount at which the status of the ink cartridge 45 is determined to be the end status, image density significantly decreases. If the usage-based charging based on the ink consumption amount calculated from the image data by the ink counter 46 is implemented also in this case, a charge may exceed an amount of money for an actual ink consumption amount.

Moreover, as described above, the initial ink fill amount may be more than the amount guaranteed to the user. If the usage-based charging is implemented also for the excess amount of ink, the total charge may be more than an initially estimated amount such as the purchase price of the ink cartridge 45 when the user purchases it at a fixed price. Thus, if the usage-based charging based on the ink consumption amount is uniformly implemented until the ink is exhausted, it may become disadvantageous charging especially for users. Accordingly, in the present embodiment, when the ink consumption amount reaches the near end value, the charging basis is changed.

Figure 5A:
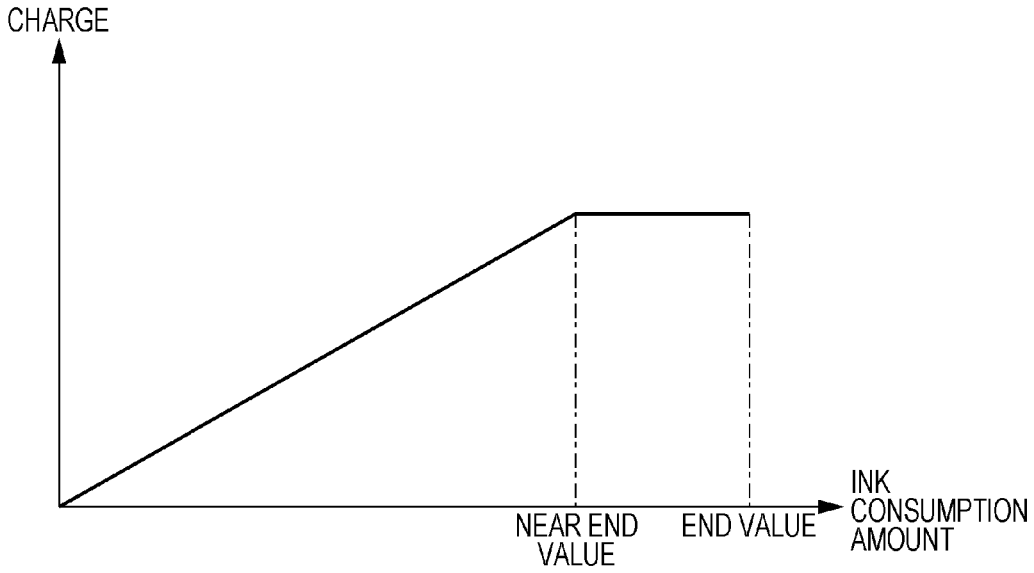
FIG. 5A illustrates an example of the charging basis after detecting near end.
Figure 5B:
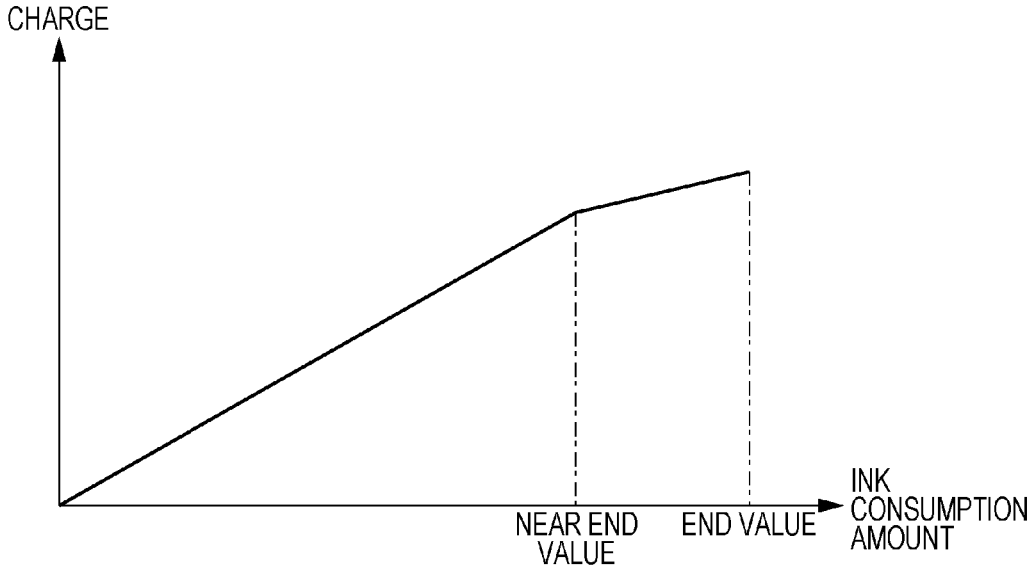
FIG. 5B illustrates an example of the charging basis after detecting the near end.

FIGS. 5A, 5B, 6A, and 6B illustrate examples of the charging basis after detecting the near end status. As FIG. 5A illustrates, the simplest charging basis is making no charge after detecting the near end status. The amount of ink left in the ink cartridge 45 after detecting the near end status is an excess amount of ink pre-filled due to the convenience of the ink supplier. By not charging for usage of that ink, unexpected financial burdens to the user can be avoided.

Meanwhile, even after detecting the near end status, printing is possible for a while at a certain image quality. Thus, under such circumstances, it is not necessarily reasonable for the ink supplier to bear the whole cost of the excess amount of ink used by the user. Therefore, in the example of FIG. 5B, after detecting the near end status, a unit price, by which the ink consumption amount is to be multiplied, is set to be lower than before detecting the near end status. This means that the inclination of the graph is set to be less steep than before detecting the near end status. Accordingly, charging is implemented for the ink consumption amount also after detecting the near end status. However, the unit price of the ink is lower than before detecting the near end status. This can balance cost burdens to the user and the ink supplier.

Moreover, an ink consumption amount calculated on the basis of the image data may have an error in the first place. Thus, charging not based on the calculated ink consumption amount may be implemented after detecting the near end status.

For instance, the methods of charging for ink include the charging based on an ink consumption amount, which is described above, and charging of a certain amount for one ink cartridge 45. In both charging methods, it is preferable that charges be the same when the user has used up the whole ink cartridge 45. However, the calculation of the ink consumption amount may cause an error as described above. Thus, in some cases, the charges are not the same in the two charging methods.

Here is an example of how to solve such a problem. A selling price per ink cartridge 45 is preset. The usage-based charging is implemented before detecting the near end status. When the use of the ink cartridge 45 is finished, the difference between a usage-based charge and the selling price is charged. By so doing, when the ink cartridge 45 is continuously used after detecting the near end status, total charges in the two charging methods are the same. Meanwhile, when the use of the ink cartridge 45 is finished before detecting the near end status, charging based on the ink consumption amount is implemented. This charging method will not be disadvantageous for the users, but are likely to be accepted.

In the charging method, it is necessary to decide at which time point the use of the ink cartridge 45 is considered finished. For instance, in the example of FIG. 6A, when the ink consumption amount reaches the end value, the use of the ink cartridge 45 is determined to be finished. At this time point, the one-time charging of the difference between the usage-based charge and the selling price is implemented. In the end status, the use of the ink cartridge 45 is stopped. Thus, even if the ink cartridge 45 is still attached to the printer 4, the ink is no longer used. Accordingly, when the status of the ink cartridge 45 reaches the end status, it is reasonable to implement the one-time charging.

Figure 6A:
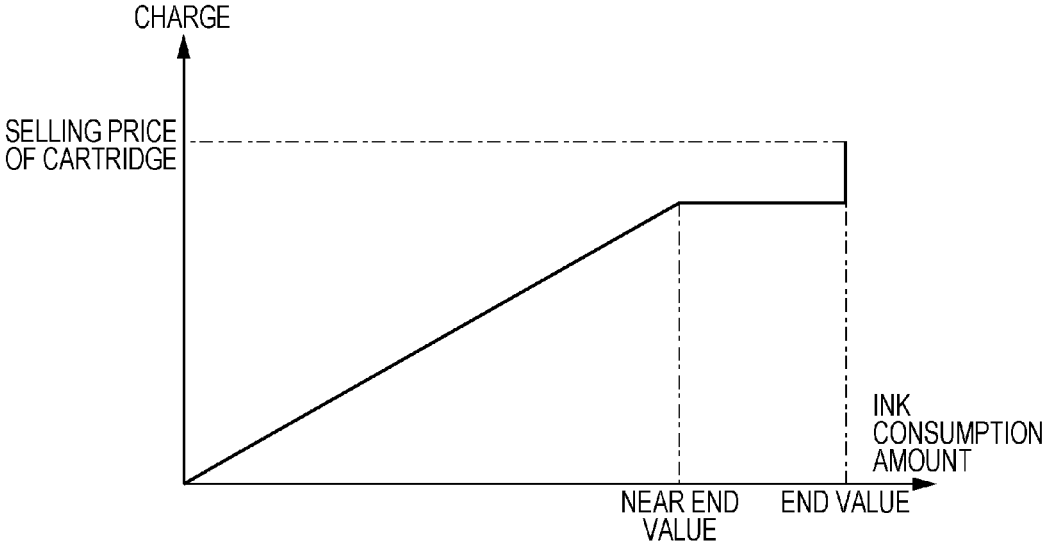
FIG. 6A illustrates an example of the charging basis after detecting the near end.
Figure 6B:
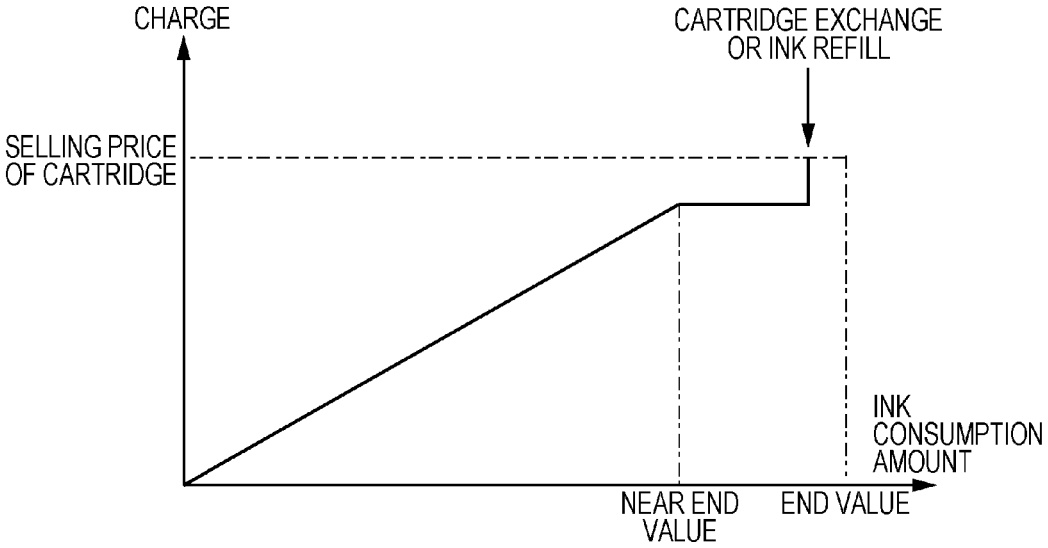
FIG. 6B illustrates an example of the charging basis after detecting the near end.

Moreover, in the example of FIG. 6B, the use of the ink cartridge 45 is determined to be finished when ink cartridge exchange is made, i.e., the ink cartridge 45 in use is detached and replaced by an unused ink cartridge 45. At this time point, the one-time charging is implemented. Moreover, for a printer in which the ink cartridge 45 can be externally refilled, ink refilling is considered equivalent to the cartridge exchange, and at the time of the ink refilling, the one-time charging is implemented. It should be noted that at the time of the cartridge exchange or ink refilling, there may be some ink left in the ink cartridge 45. To eliminate user's dissatisfaction with a charge for the unused ink, a one-time charging charge may be determined on the basis of an ink consumption amount calculated at the time of occurrence of the charging.

If the one-time charging is implemented for the rest of the ink shortly after the status of the ink cartridge 45 is changed to the near end status, this would give the user the impression that the pace of charging is faster than before the near end status is detected. In the present embodiment, "the condition that the status of the ink cartridge 45 is changed to the end status" and "the condition that the cartridge exchange has been made" are set to "the charging start condition" in step S206. When either condition is satisfied, the one-time charging of the difference between the usage-based charge and the selling price is implemented. This not only avoids incurring excess financial burdens to the user, but also enables appropriate charging based on actual ink consumption by the user.

As described above, in the charging system 1 in the present embodiment, the charging server 3 functions as "a charging device" of the invention including "a charging implementation unit" of the invention. The printer 4 functions as "the printing device" of the invention. The internet communications network 2 is "the communications network" of the invention. In the printer 4, the printer engine 42, the UI 44, the ink cartridge 45, and the ink counter 46 function as "the printing unit", "the notification unit", "the ink container", and "the information obtaining unit" of the invention, respectively.

Moreover, the near end value, which is a threshold set for an integrated value obtained by integrating ink consumption amounts, is "the predetermined value" of the invention. Moreover, the usage-based charging before detecting the near end status is "the first charging" of the invention. The one-time charging after detecting the near end status or charging implemented at a unit price lower than before detecting the near end status is "the second charging" of the invention. Examples of "the second charging" also include making no charge after detecting the near end status.

It should be noted that the invention is not limited to the above embodiment, but various modifications can be made to the embodiment without departing from the scope of the invention. For instance, in the embodiment, the threshold of the ink consumption amount is set to "the near end value" at which image quality would decrease. When the value of the ink consumption amount reaches the near end value, the notification to the user and the change of the charging basis are made. However, the notification to the user that there is a small amount of ink left and the change of the charging basis may be made at different times. For instance, when the status of the ink cartridge 45 is changed to the near end status, only the warning notification to the user may be made. When the ink consumption amount further increases by a certain amount, the charging basis may be changed.

In the present embodiment, the near end value corresponding to "the predetermined value" of the invention is a predetermined fixed value. However, the near end value may be changeable where necessary. After staring using the ink cartridge 45, a liquid component of the ink gradually evaporates, and an amount of ink left decreases in the long term. In this case, it is possible that there is a gap between an estimated usable amount of ink and an actual usable amount of ink and that the initially set "near end value" does not serve as the indication of the near end status. To solve the problem, "the predetermined value" of the invention, i.e., the near end value of the above embodiment may be changeable as the time elapses. This deals with the case in which there is a change in amount of ink, and enables appropriate charging for an actual ink consumption amount.

In other example, if the charging system 1 includes more than one printer 4 and the charging server 3 performs charging management on the printers 4, "the predetermined value" of the invention may be set to a different value for each printer 4. Because of the individual variations of the printers 4, an ink consumption amount necessary for obtaining the same printed product may be different between the printers 4. To compensate for such individual variations and implement fair charging, the setting of "the predetermined value" of the invention, i.e., the near end value in the present embodiment for each printer 4 is effective.

In the above embodiment, the ink counter 46 in the printer 4 calculates an ink consumption amount consumed by the printer engine 42. That is, the printer 4 includes "the information obtaining unit" of the invention. Instead of this configuration, the charging server 3 may include a unit corresponding to "the information obtaining unit" of the invention. Moreover, in a system in which at least two printers 4 are connected to the same LAN, an intermediary server may be provided that collects information on ink consumption amounts from these printers 4 and transmits the information to the charging server 3. In this case, the intermediary server functions as "the information obtaining unit" of the invention.

In the above embodiment, "the charging implementation unit" of the invention is installed to the charging server 3 communicably connected to the printer 4 via the Internet communications network 2. However, this is not the only example. For instance, in a case in which technical service staff regularly visits a user and provides maintenance services for the printer 4, the staff may operate the printer 4 and determine charges. In this case, for instance, the controller 41 of the printer 4 may function as "the charging implementation unit" of the invention, or a check device carried by the technical service staff can be connected to the printer 4 and used as "the charging implementation unit".

This application claims priority under 35 U.S.C. §119 to Japanese Patent Application No. 2015-142714, filed Jul. 17, 2015. The entire disclosure of Japanese Patent Application No. 2015-142714 is hereby incorporated herein by reference.

What is claimed is:

1. A method of charging for ink in an ink container consumed by a printing unit during printing, the method comprising:

obtaining information on an amount of the ink consumed by performing one or more processes that comprise calculating, by an ink counter of a detector, the amount of ink consumed from the ink container; and implementing charging on the basis of the information;

wherein (i) when the ink counter detects that the ink container is in a first consumption amount status, first charging is implemented for the ink container according to a charging basis in which usage-based charging is implemented on the basis of the amount of the ink consumed, and (ii) after the detector detects that the ink container is in a second consumption amount status, second charging is implemented for the ink container according to a charging basis different from the charging basis applied to the first charging.

2. The method of charging according to claim 1, wherein a charge per ink consumption amount in the second charging is less than a charge per ink consumption amount in the first charging.

3. The method of charging according to claim 2, wherein a charge of the second charging is zero.

4. The method of charging according to claim 1, wherein in the second charging, one-time charging is implemented for ink usage after the detector detects that the ink container is in second consumption amount status.

5. The method of charging according to claim 4, wherein the second charging is implemented after the detector detects that the ink container is in the second consumption amount status and after a predetermined charging start condition is satisfied.

6. The method of charging according to claim 5, wherein the ink container is attachable to and detachable from the printing unit, and the charging start condition is that the ink container in an unused state has been attached to the printing unit.

7. The method of charging according to claim 5, wherein the charging start condition is that exhaustion of ink in the ink container is detected.

8. The method of charging according to claim 5, wherein the charging start condition is that ink refilling for the ink container is detected.

9. The method of charging according to claim 1, wherein the first ink consumption amount status of the ink container is a status in which an amount of ink left in the ink container is more than the minimum amount of ink necessary for performing printing.

10. The method of charging according to claim 1, wherein the first ink consumption amount status of the ink container is associated with a threshold amount of ink consumed from the ink container, and the threshold amount of ink is changed according to elapsed time since use of the ink container is started.

11. The method of charging according to claim 1, wherein a charging device obtains the information from the printing unit and implements charging, the printing unit being connected to the charging device via a communications network.

12. A method of charging according to claim 1, wherein the detector includes an ink end sensor configured to (i) detect an amount of ink remaining in the ink container, and (ii) detect the second consumption amount status of the ink container.

13. A charging system comprising:

a printing unit configured to print using ink in an ink container;

an information obtaining unit configured to obtain information on an amount of the ink consumed from the ink container, the information obtaining unit comprising a detector that comprises an ink counter configured to calculate the amount of ink consumed from the ink container and to detect a first consumption amount status of the ink container; and a charging implementation unit configured to charge for the amount of the ink consumed from the ink container, on the basis of the information obtained by the information obtaining unit, wherein the charging implementation unit is configured such that (i) when the ink counter detects that the ink container is in a first consumption amount status of the ink container, the charging implementation unit implements charging for the ink container according to a charging basis in which usage-based charging is implemented on the basis of the amount of the ink consumed, and (ii) when the detector detects that the ink container is in a second consumption amount status of the ink container, the charging basis for the ink container is changed.

14. The charging system according to claim 13, wherein the ink container is detachably attached to the printing unit.

15. The charging system according to claim 13, further comprising a notification unit configured to generate a notification when the detector detects that the ink container is in the second consumption amount status.

16. The charging system according to claim 13, wherein a printing device and a charging device are connected via a communications network, the printing device including the printing unit and the information obtaining unit, the charging device including the charging implementation unit.

* * * * *